US005794992A

United States Patent [19]

Yoneyama

[11] Patent Number: 5,794,992

[45] Date of Patent: Aug. 18, 1998

[54] PROTECTED VEHICLE DOOR LATCH DEVICE

[75] Inventor: Fumihiro Yoneyama, Yamanashi-ken, Japan

[73] Assignee: Mitsui Kinzoku Kogyo Kabushiki Kaisha, Tokyo, Japan

[21] Appl. No.: 751,515

[22] Filed: Nov. 15, 1996

[30] Foreign Application Priority Data

Nov. 17, 1995 [JP] Japan ..... 7-324095

[51] Int. Cl.[6] ..... E05C 3/06

[52] U.S. Cl. ..... 292/216; 292/DIG. 23

[58] Field of Search ..... 292/346, 216, 292/DIG. 23

[56] References Cited

U.S. PATENT DOCUMENTS

| | | | |
|---|---|---|---|
| 2,948,561 | 8/1960 | Eatinger | 292/DIG. 23 |
| 4,518,182 | 5/1985 | Cousin | 292/216 |
| 4,762,348 | 8/1988 | Mastsumoto | 292/DIG. 23 |
| 4,904,006 | 2/1990 | Hayakawa et al. . | |
| 5,035,453 | 7/1991 | Fukumoto et al. . | |
| 5,435,609 | 7/1995 | Igata | 292/346 |
| 5,454,607 | 10/1995 | Ishihara | 292/DIG. 23 |
| 5,474,339 | 12/1995 | Johnson | 292/216 |
| 5,649,726 | 7/1997 | Rogers | 292/DIG. 23 |

*Primary Examiner*—Flemming Saether
*Attorney, Agent, or Firm*—Browdy and Neimark

[57] ABSTRACT

A door latch device comprises a latch body fixed at its front side to a door, a latch for engaging with a striker, a ratchet for maintaining the engagement between the latch and striker, an opening mechanism for releasing the ratchet from the latch, a locking mechanism displaceable between a locked condition and an unlocked condition, a stationary plate attached to a rear side of the latch body and projecting rearwardly, and an actuator fixed to the stationary plate for displacing the locking mechanism between the locked condition and the unlocked condition. The actuator has a substantially closed housing, an output shaft projecting outward from the housing, and an output lever fixed to the output shaft and coupled to the locking mechanism. A gap is formed between the housing and the stationary plate. The output lever is located in the gap.

8 Claims, 6 Drawing Sheets

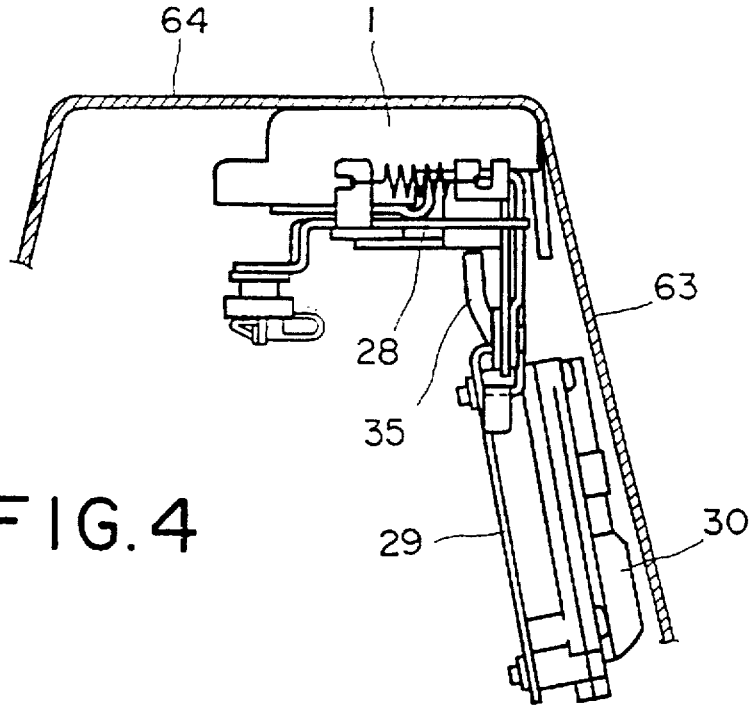
FIG. 4
FIG. 5
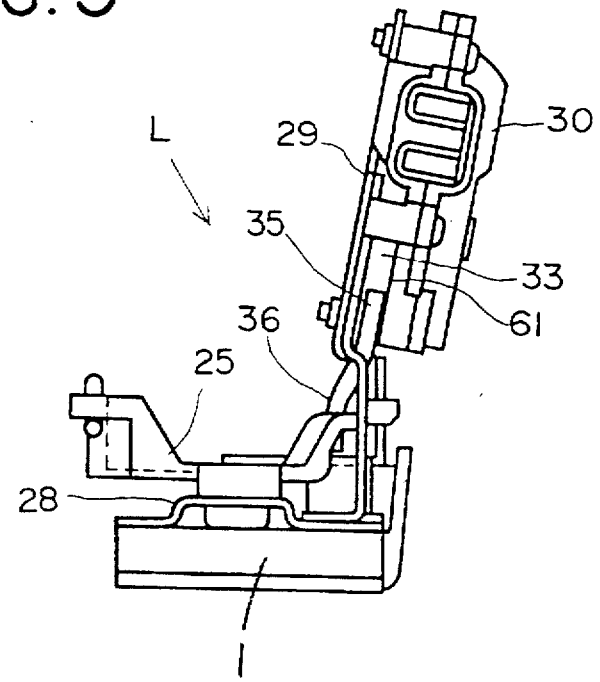

PROTECTED VEHICLE DOOR LATCH DEVICE

BACKGROUND OF THE INVENTION

1. Field of the Invention

The present invention relates to a vehicle door latch device, and in particular, to a door latch device with which unauthorized operation for cancelling a locked condition of the latch device cannot hardly be made.

2. Prior Art of the Invention

A conventional door latch device has a latch body secured to a door, a latching mechanism adapted to be engaged with a striker fixed to a vehicle body, an opening mechanism for releasing the engagement between the latching mechanism and the striker, and a locking mechanism for disabling an opening operation of the opening mechanism. As shown in FIG. 9, the latch body A is fixed to the door C so that a front surface B of the latch body A makes contact with a peripheral wall D of the door C. The opening mechanism and locking mechanism (not shown in FIG. 9) are attached to a rear surface E of the latch body A.

Since the locking mechanism attached to the rear surface E can be accessed by a gripping tool or the like which is inserted through a gap between the door panel and a closed window glass, in the conventional door latch device, a protecting plate which covers the locking mechanism is attached to the rear side of the latch body so as to protect the locking mechanism from unauthorized cancelling operation.

Meanwhile, the conventional door latch device has an actuator for changing over the locking mechanism between a locked condition and an unlocked condition. This actuator is sometimes attached to a lower portion of the latch body as disclosed in U.S. Pat. No. 4,904,006, and sometimes attached to a metal back plate which is fixed to the latch body and projects rearward, as disclosed in U.S. Pat. No. 5,035,453.

In the latter arrangement, as shown in FIG. 9, the actuator F can be attached at a position where it does not interfere with a window glass G, thereby the design of the actuator F can be facilitated, and the attachment of the actuator F to the latch device can be facilitated. However, it is difficult to attach the protecting plate to the latter arrangement device. Because the protecting plate for the latter arrangement device is sized so as to cover intermediate members between the actuator and the locking mechanism in addition to the locking mechanism, and has a risk such that it interferes with the window glass G. Accordingly, the protecting plate is, in general, not attached to latter device.

SUMMARY OF THE INVENTION

Accordingly, an object of the present invention is to provide a vehicle door latch device which can enhance the burglar-proof ability for the intermediate members between the actuator and the locking mechanism without using a large sized protecting plate.

The present invention will be hereinbelow described in the form of a preferred embodiment with reference to the accompanying drawings.

BRIEF DESCRIPTION OF THE DRAWINGS

FIG. 4 is a plan view of the latch body;

FIG. 5 is a bottom view of the latch body;

DESCRIPTION OF THE PREFERRED EMBODIMENT

Figure 1:
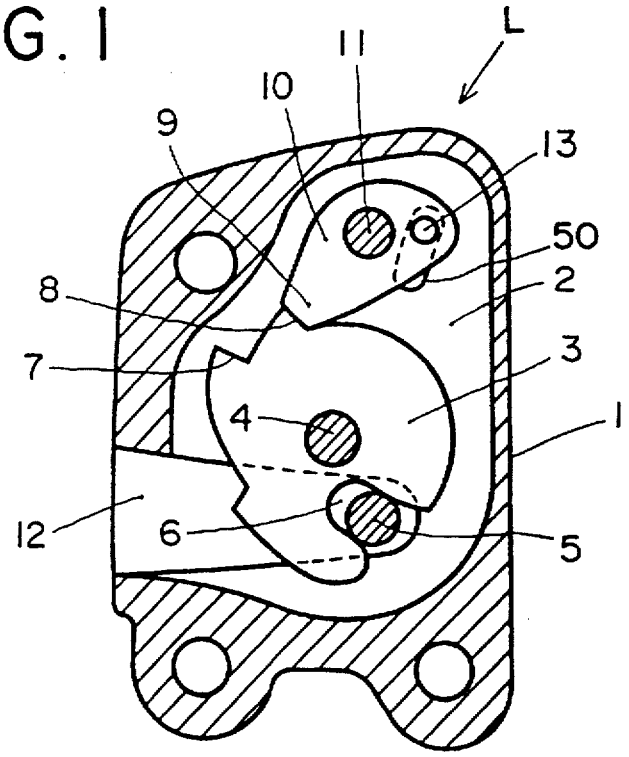
FIG. 1 is a longitudinally sectioned front view showing a latch body according to the present invention.
Figure 9:
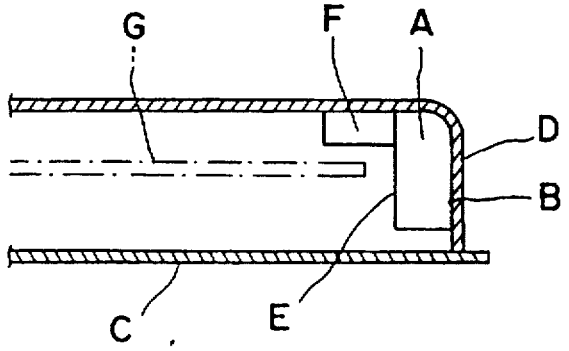
FIG. 9 (PRIOR ART)
FIG. 9 is a view illustrating a conventional vehicle door latch device.

An embodiment of the present invention will now be described with reference to the accompanying drawings. A door latch device L, according to the present invention, comprises, a latch 3 adapted to be engaged with a striker 5 fixed to a vehicle body, and a ratchet 10 for holding the engagement between the latch 3 and the striker 5. The latch 3 and the ratchet 10 are rotatably received in a recess 2 formed in the front side of a latch body 1 made of synthetic resin, by means of a latch shaft 4 and a ratchet shaft 11, respectively. The latch 3 is urged clockwise as shown in FIG. 1 by a resilient force of a spring (not shown), and the ratchet 10 is urged counterclockwise by a resilient force of a spring (not shown). The latch body 1 is fixed to a door 63 (FIG. 4) so that the front surface thereof makes contact with a peripheral wall 64 of the door 63.

When the door is closed, the striker 5 enters a horizontal passage 12 formed in the latch body 1, and is then engaged with a fork part 6 of the latch 3. When the latch 3 is turned to a half-latch position through the engagement with the striker 5, a pawl 9 of the ratchet 10 is engaged with a half-latch stepped part 7 of the latch 3, and when the latch 3 is turned to a full-latch position, the pawl 9 is engaged with a full-latch stepped part 8.

The ratchet 10 has a ratchet pin 13 which is projected in the rear side of the latch body 1 through an opening 50 formed in the latch body 1. When the ratchet pin 13 is turned downward by means of an opening mechanism 51 which will be hereinbelow described, the ratchet 10 is disengaged from the latch 3 so as to open the door.

Figure 2:
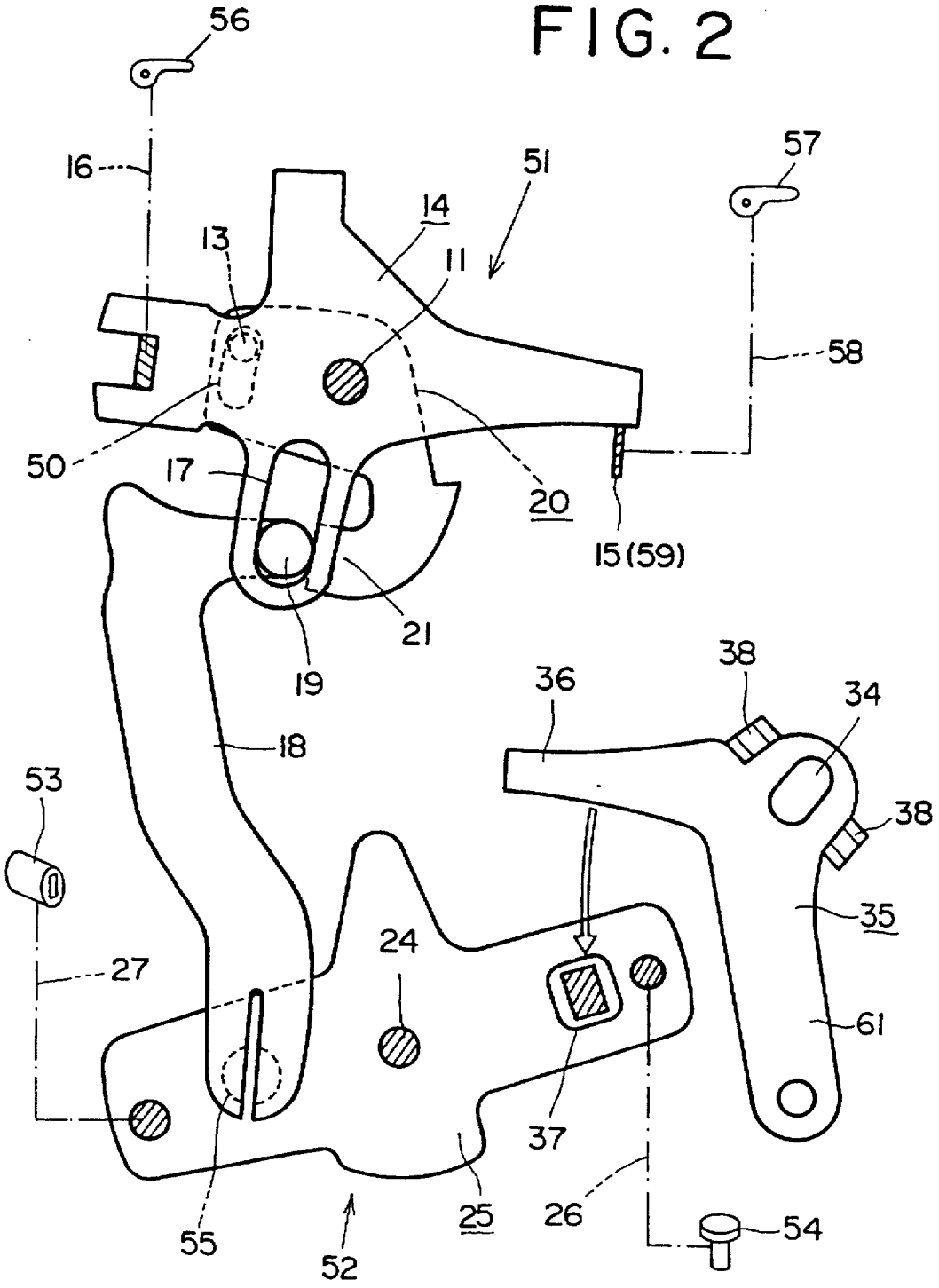
FIG. 2 is an enlarged view showing an opening mechanism and a locking mechanism which are provided in a rear side of the door latch body shown in FIG. 1.

FIG. 2 shows the opening mechanism 51 and a locking mechanism 52 which are provided on the rear side of the latch body 1. The locking mechanism 52 has a lock lever 25 coupled to a key cylinder 53 and an inside lock button 54 of the door 63 through rods 27 and 26, respectively, and a lock link 18 rotatably attached to the lock lever 25 by means of a snap fastener 55. The lock lever 25 is rotatably attached to a metal back plate 28 fixed to the rear side of the latch body 1 by means of a shaft 24.

Figure 6:
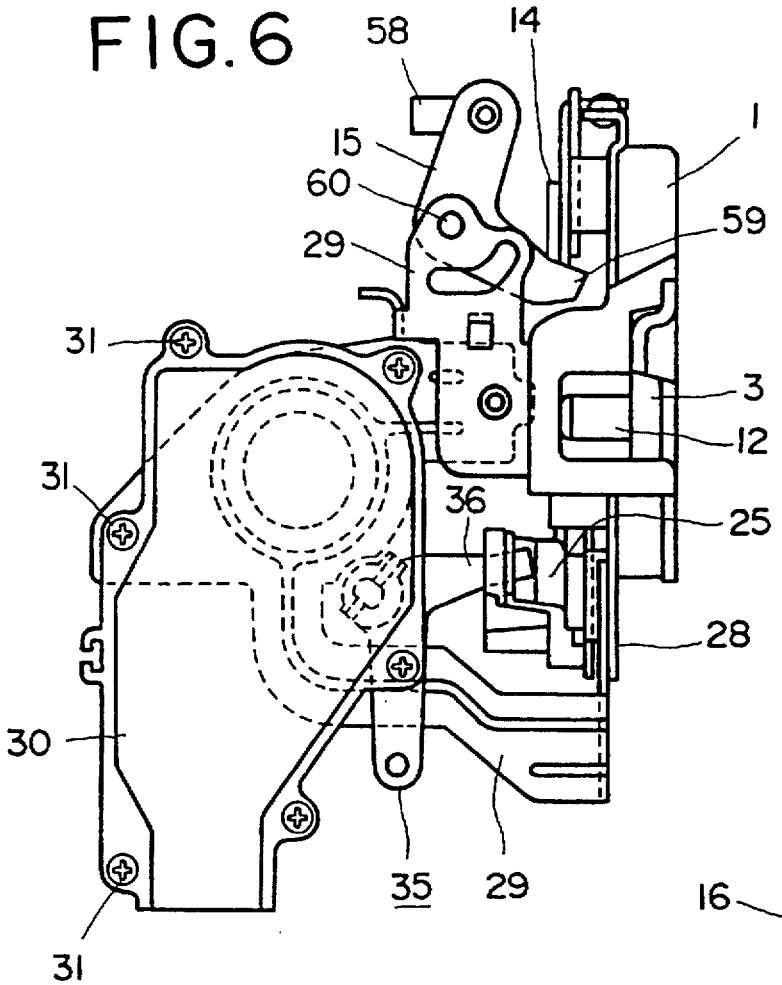
FIG. 6 is a view showing an interior side of the door latch device.
Figure 7:
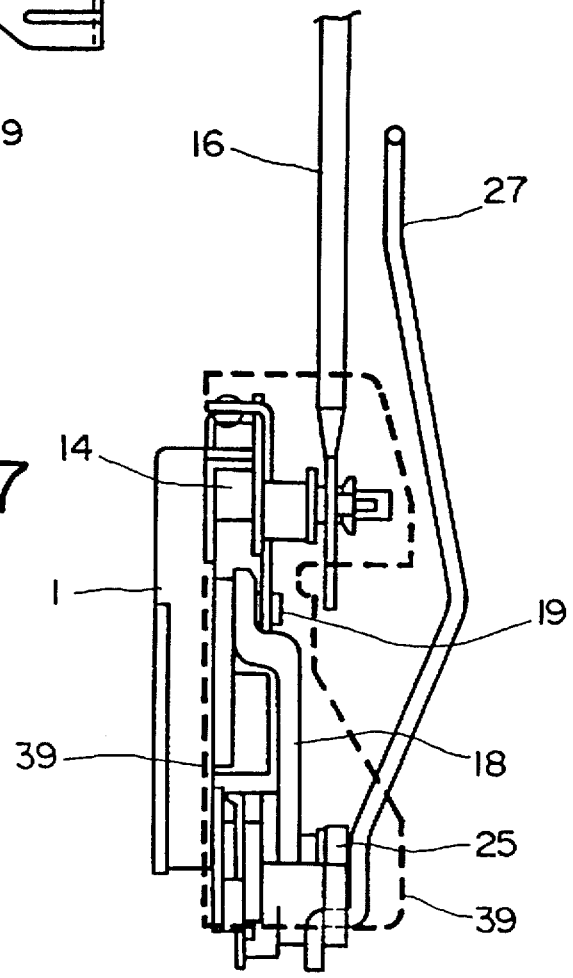
FIG. 7 is a view showing an exterior side of the door latch device.
Figure 8:
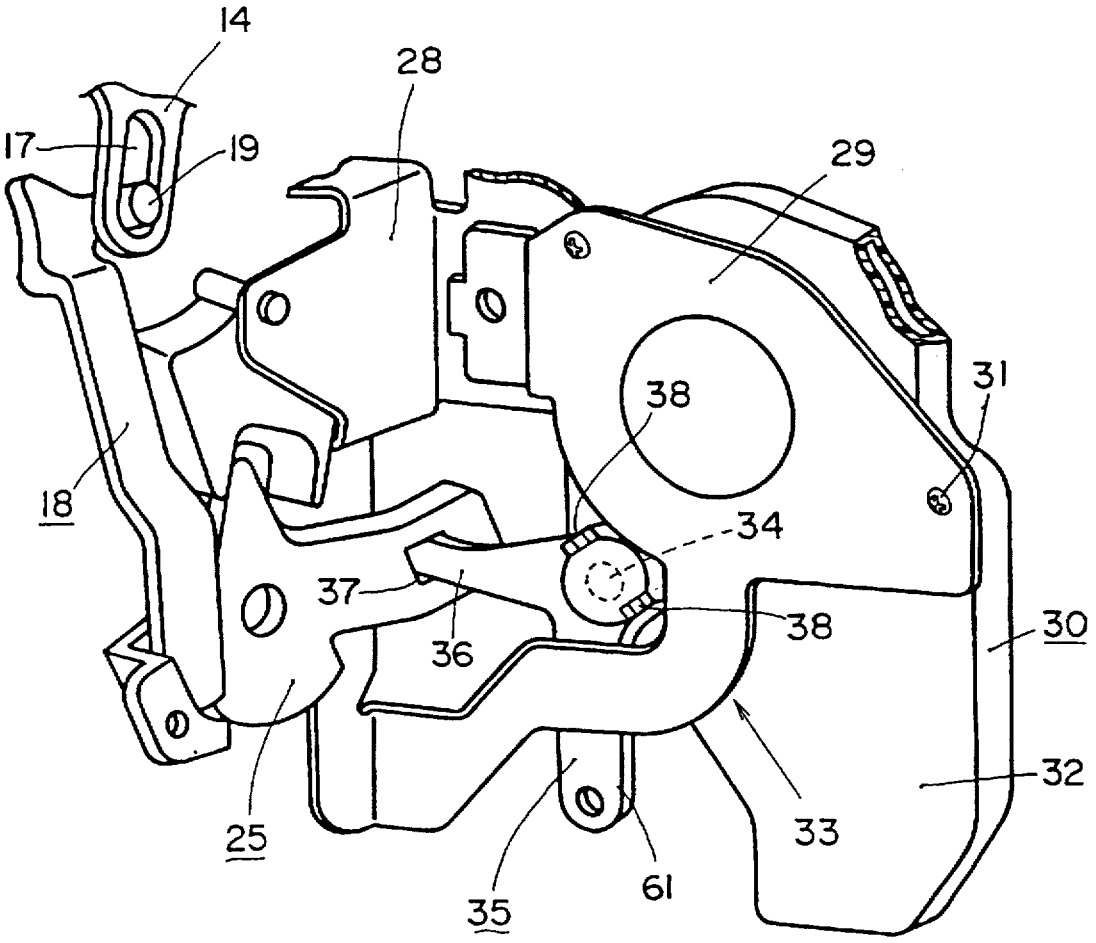
FIG. 8 is a perspective view showing intermediate members between an actuator and the locking mechanism.

The opening mechanism 51 has a ratchet lever 20 coupled to the ratchet 10 through the ratchet pin 13, an open lever 14 coupled to an outside open handle 56 of the door 63 through a rod 16, and an inner lever 15 (FIG. 6) coupled to an inside open handle 57 of the door 63 through a rod 58. When the inner lever 15 is turned by the open handle 57, one end portion 59 of the inner lever 15 makes contact with the open lever 14 and rotates it. The ratchet lever 20 and the open lever 14 are rotatably supported to the ratchet shaft 11.

The open lever 14 has an elongated hole 17 in which an engaging pin 19 formed on the upper end of the lock link 18 is slidably engaged. The pin 19 is opposed to a tip end of a curved arm 21 of the ratchet lever 20, as shown in FIG. 2, when the locking mechanism 52 is unlocked. Accordingly, the turn of the open lever 14 causes the pin 19 to engage with the curved arm 21 so as to turn the ratchet lever 20 and the ratchet 10, the door is then opened. When the locking mechanism 52 is displaced to the locked condition, the pin 19 is moved upward in FIG. 2 so that it is separated from the tip end of the curved arm 21. Accordingly, the turn of the open lever 14 at the locked condition cannot cause the ratchet lever 20 and the ratchet 10 to turn.

A sub plate 29 is secured to an interior side of the back plate 28 fixed to the rear side of the latch body 1 and projects rearward. Preferably, the sub plate 29 is integrally formed with the back plate 28. An actuator 30 for changing over the lock lever 25 between the locked position and the unlocked position is attached to the lower portion of the sub plate 29, and the inner lever 15 is attached to the upper portion of the sub plate 29 by means of a shaft 60.

The actuator 30 has a substantially closed housing 32 made of synthetic resin. A motor and a speed reducing mechanism, both of which are not shown, are provided in the housing 32. The housing 32 is fixed to the interior side of the sub plate 29 with the use of screws 31 or the like. As shown in FIG. 5, a recess 61 is formed in the exterior side of the housing 32 to define a gap 33 between the housing 32 and the sub plate 29. An output shaft 34 of the actuator 32 is located in the recess 61. The gap 33 is substantially closed at its top and rear sides by means of the housing 32 and the sub plate 29. An L-like output lever 35, having a first arm 36 projected forward and a second arm 61 projected downward, is attached to the shaft 34 by means of screws 38 or the like. The forward tip end of the first arm 36 is engaged in an engaging hole 37 formed in the lock lever 25. When the output lever 35 is turned by the actuator 30, the lock lever 25 is changed over between the locked position and the unlocked position.

The output lever 35 attached to the output shaft 34 is accommodated in the recess 61 or gap 33 and is surrounded at its top side and rear side by the housing 32 and sub plate 29. Thus, the output lever 35 can hardly be accessed by a gripping tool which is inserted through the gap between the door panel and the window glass. Further, since the output lever 35 can be protected without using a large sized protecting plate, the latch device L can be easily fixed to the door.

Figure 3:
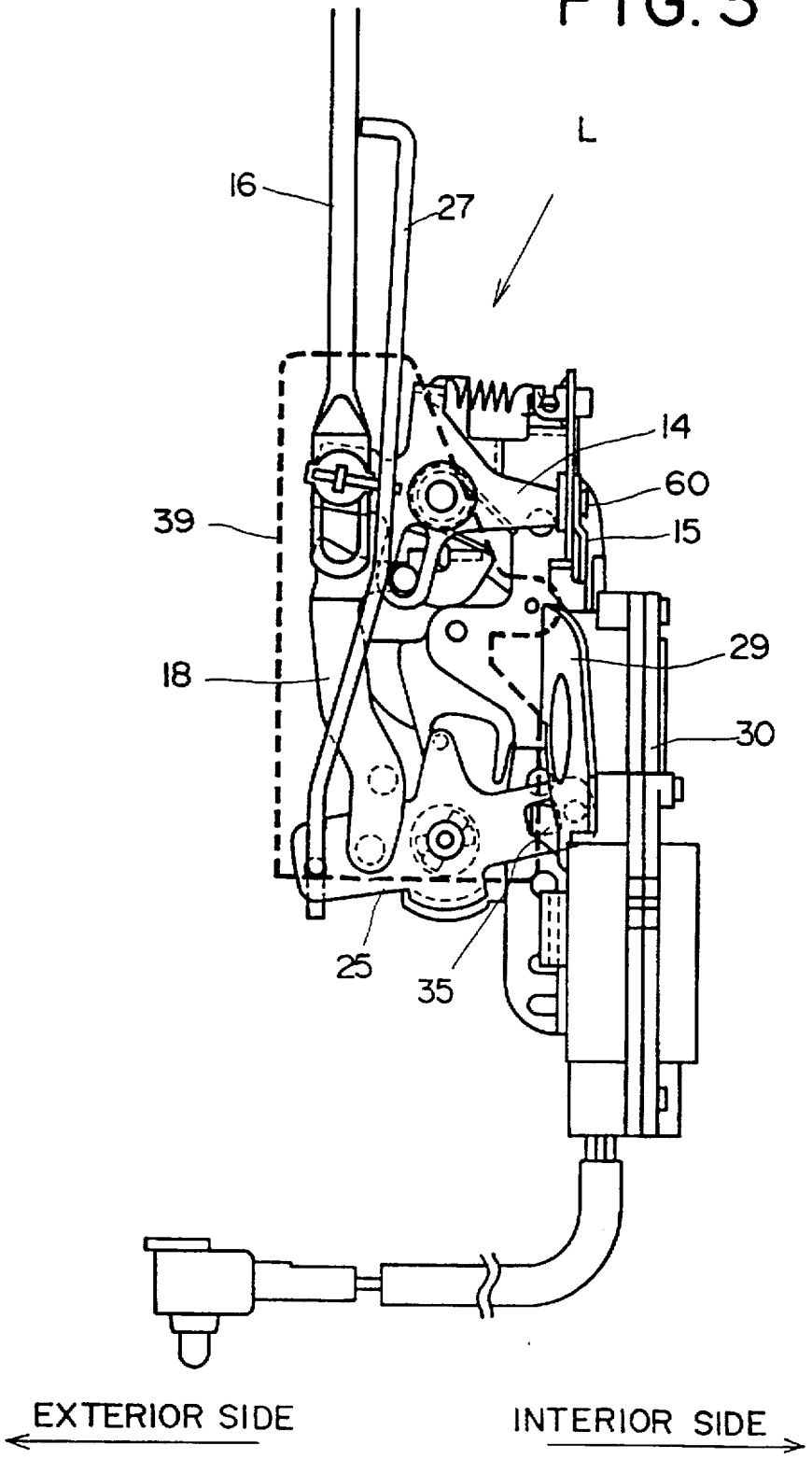
FIG. 3 is a rear view of the latch body.

It is noted that the conventional type protecting plate 39, indicated by the chain line in FIG. 3, for covering the opening mechanism 51 and the locking mechanism can be useable.

What is claimed is:

1. A door latch device for use with a door of a vehicle body comprising:

a latch body fixed at its front side to the door;

a latch rotatably attached to the latch body for engaging with a striker fixed to the vehicle body;

a ratchet rotatably attached to the latch body for maintaining the engagement between the latch and striker by engaging with the latch;

an opening mechanism for releasing the ratchet from the latch;

a locking mechanism displaceable between a locked condition for disabling an opening operation of the opening mechanism and an unlocked condition for enabling the opening operation of the opening mechanism;

said opening mechanism and said locking mechanism being disposed on a rear side of the latch body;

a stationary plate attached to the rear side of the latch body having a portion projecting rearwardly from an interior side of the rear side of the latch body;

an actuator for displacing the locking mechanism between the locked condition and the unlocked condition, said actuator having a substantially closed housing which is fixed to the portion of the stationary plate projecting rearwardly at a position spaced away from the latch body out of contact with the latch body, an output shaft projecting from the housing toward the portion of the stationary plate projecting rearwardly, and an output lever fixed to the output shaft and coupled to the locking mechanism; and a gap formed between the housing and said portion of the projecting rewarding stationary plate projecting rearwardly, wherein said output lever is located in the gap.

2. A door latch device as set forth in claim 1, wherein said gap is substantially closed at a top and rear sides of said gap by the housing and the portion of stationary plate projecting rearwardly when the door latch device is in use on the door.

3. A door latch device as set forth in claim 1, wherein said housing has a recess which is opposite to the portion of the stationary plate projecting rearwardly so as to define the gap.

4. A door latch device as set forth in claim 1, wherein said housing is fixed to an interior side of the portion of the stationary plate projecting rearwardly.

5. A door latch device as set forth in claim 1, wherein said opening mechanism has an inner lever coupled to an inside open handle of the door, and said inner lever is rotatably attached to the portion of the stationary plate projecting rearwardly.

6. A door latch device as set forth in claim 5, wherein said inner lever is attached to an upper portion of the portion of the stationary plate projecting rearwardly, and said actuator is attached to a lower area of the portion of the stationary plate projecting rearwardly.

7. A door latch device as set forth in claim 1, wherein said locking mechanism has a lock lever coupled to a key cylinder and/or an inside lock button of the door, and said lock lever is rotatably attached to the latch body by a support shaft which is orthogonal to an axis of the output shaft.

8. A door latch device as set forth in claim 1, wherein said stationary plate has a main plate integrally formed with the portion of the stationary plate projecting rearwardly, said main plate attached to a rear surface of said latch body.

* * * * *